US010352667B2

(12) United States Patent
Salvino

(10) Patent No.: US 10,352,667 B2
(45) Date of Patent: Jul. 16, 2019

(54) BROADHEAD WITH EXTENDABLE BLADES AND HOLLOW CYLINDRICAL SLIDING PORTION

(71) Applicant: Nevin R. Salvino, Wauconda, IL (US)

(72) Inventor: Nevin R. Salvino, Wauconda, IL (US)

( * ) Notice: Subject to any disclaimer, the term of this patent is extended or adjusted under 35 U.S.C. 154(b) by 0 days.

(21) Appl. No.: 16/135,439

(22) Filed: Sep. 19, 2018

(65) Prior Publication Data

US 2019/0086187 A1 Mar. 21, 2019

Related U.S. Application Data

(60) Provisional application No. 62/560,643, filed on Sep. 19, 2017.

(51) Int. Cl.
*F42B 6/08* (2006.01)
*F42B 12/34* (2006.01)

(52) U.S. Cl.
CPC ..... *F42B 6/08* (2013.01); *F42B 12/34* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 6,517,454 | B2 * | 2/2003 | Barrie | F42B 6/08 473/583 |
| 6,554,727 | B1 * | 4/2003 | Armstrong | F42B 6/08 473/583 |
| 6,595,881 | B1 * | 7/2003 | Grace, Jr. | B22F 3/22 473/583 |
| 7,226,375 | B1 * | 6/2007 | Sanford | F42B 6/08 473/583 |
| 7,713,151 | B2 * | 5/2010 | Fulton | F42B 6/08 473/583 |
| 7,771,298 | B2 * | 8/2010 | Pulkrabek | F42B 6/08 473/583 |
| 9,903,693 | B2 * | 2/2018 | Salvino | F42B 6/08 |
| 2009/0029611 | A1 * | 1/2009 | Spencer | A41D 13/0007 441/114 |

* cited by examiner

*Primary Examiner* — John A Ricci

(57) ABSTRACT

A broadhead mountable to an arrow shaft for striking a target, upon striking impact is created which deploys the broadhead from a pre-deployment configuration to a post-deployment configuration. The broadhead including a longitudinally extending body, which includes a means for retaining a plurality of mechanically expandable blades while in a post-deployment configuration. The longitudinally extending body including a means for securing the plurality of mechanically expandable blades to the body while in both the pre-deployment configuration and the post-deployment configuration. The broadhead includes a means for not deploying the blades until impact with the target. The broadhead includes a means for deploying a front blade upon impact. The means for deploying the front blade upon impact is mounted over the longitudinally extending body with an alignment position to secure each blade and to set the broadhead in the pre-deployment configuration.

20 Claims, 5 Drawing Sheets

BROADHEAD WITH EXTENDABLE BLADES AND HOLLOW CYLINDRICAL SLIDING PORTION

PRIORITY

This application claims priority from U.S. provisional patent application Ser. No. 62/560,643, filed Sep. 19, 2017, entitled "Balloon with Ball Valve and Broadheads," which is incorporated herein by reference in its entirety.

FIELD OF DISCLOSURE

The present disclosure relates generally to arrowheads and, more specifically, to a type of arrowhead referred to as a broadhead, having an arrow tip and blades that are tucked in during flight and are deployed when the arrow strikes its target.

BACKGROUND

Broadhead arrowheads are known in the bow hunting art. In particular, broadheads having auxiliary blades that deploy when the arrow strikes its target are also known and will be referred to generally as expanding or expandable broadheads.

Expandable broadheads allow an arrowhead to have a relatively small and streamlined configuration during flight to enhance accuracy. Upon striking a target, a set of auxiliary blades expand for the purpose of enlarging the entrance wound, enabling a more certain and humane kill.

U.S. Pat. No. 6,517,454 (Barrie et al) discloses a broadhead with sliding, expanding blades. The blades are pivotally attached to the arrowhead and are held closed in flight by a rubber restraint. When the arrowhead penetrates the target, the forward edges of the blades also contact the target forcing the blades rearward, severing the restraint and allowing the trailing edges of the blades to dispose outward to a V-shape thereby exposing the sharpened edges of the blades.

Published U.S. Patent Application 2009/0029811 (Bolen III) discloses an expandable broadhead and blades therefor. In Bolen, the auxiliary blades face forward with the pivots for them positioned at the rear of the arrowhead. The blades are configured to fracture if, when they expand and strike the target, they encounter a hard or solid object, such as a bone.

U.S. Pat. No. 6,554,727 (Armstrong et al) discloses a deflection-resistant arrowhead having both fixed and mechanically expandable blades. In Armstrong, the blades have a rearward pivot and face forward, and are held in place by a severable restraint during flight. When the arrowhead strikes the target, a forward edge of each expandable blade also contacts the target forcing the blades rearward around the pivot to open and thus expose the sharpened edges of the blades.

U.S. Pat. No. 6,595,881 (Grace Jr.) discloses an expanding blade-archery broadhead with the blades, in their stored position, facing forward and having a rear or trailing pivot. A sliding collar deploys forward when the arrowhead strikes its target causing the blades to extend and pivot rearward, exposing the sharpened blade edges.

U.S. Pat. No. 6,669,586 (Barrie et al) discloses an expanding broadhead having expandable blades with forward pivots attached to a collar that is slidably mounted within the arrowhead body. When the arrowhead strikes the target, the mounting ring is brought into contact with a camming surface within the arrowhead which deploys the sharpened edges of the blades by severing the restraint.

U.S. Pat. No. 6,910,979 (Barrie et al) discloses an expandable broadhead with expandable blades having arcuate slots formed thereon. The blades are mounted to the arrowhead with a guide boss positioned within the slot. When the arrowhead penetrates the target, the lead edge of each blade comes into contact with the target of the blade is forced along the arcuate slot to deploy with the sharpened blade edges exposed.

U.S. Pat. No. 7,226,375 (Sanford) discloses an expandable arrow broadhead for attachment to one end of an arrow shaft. A set of rearward extending blades, pivoted at their front end are attached to an arrowhead and are held in place by a rubber band. When the arrow strikes its target, a collar within the arrowhead slides forward contacting the blades forcing them outward with sufficient force to sever the rubber band and deploy the sharpened cutting edges.

U.S. Pat. No. 7,771,298 (Pulkrabek) discloses an expandable broadhead with rear deploying blades including a body having a fixed forward cutting blade.

U.S. Pat. No. 9,903,693 (Salvino et al.) discloses an expandable broadhead with rear deploying blades including a body having a fixed forward cutting blade.

The foregoing references are incorporated herein by reference in their entirety.

SUMMARY

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed.

Where means-plus-function clauses are used in the claims such language is intended to cover the structures described herein as performing the recited functions and not only structural equivalents but equivalent structures as well. For the purposes of the present disclosure, two structures that perform the same function within an environment described above may be equivalent structures.

A broadhead mountable to an arrow shaft for striking a target, the broadhead including a longitudinally extending body having a distal end and a proximal end. The longitudinally extending body including a plurality of longitudinally extending post-expansion grooves each groove to retain a respective one of a plurality of mechanically expandable blades. The longitudinally extending body includes a respective fastener hole] to receive each of a respective fastener of a plurality of fasteners. Each of the fasteners retains each of the respective blades of the plurality of expandable blades pre-expansion and post-expansion, when in pre-expansion the blades are retained partially inside each respective post-expansion groove. Each of the blades includes an retention groove positioned at the proximal end of each blade when in pre-expansion configuration. The longitudinally extending body includes a narrow extending portion at the distal end, and includes a post-expansion blade retention portion. A hollow cylindrical sliding portion including a pre-expansion blade retention hollow cylindrical portion and a hollow cylindrical body and a hollow tip cylindrical portion. The pre-expansion blade retention hollow cylindrical portion includes a corresponding pre-expansion groove aligned respective and corresponding to each of the plurality of expandable blades to retain each blade inside each respective pre-expansion groove when in pre-expansion configuration. The hollow cylindrical sliding portion is mounted over the longitudinally extending body with an alignment position to secure each blade with the respective fastener to set the broadhead in the pre-expansion configuration. The hollow cylindrical body mounts over the base of the narrow extending portion. The tip cylindrical portion mounts over the distal end of the narrow extending portion. The tip cylindrical portion mounts over at least a portion of a tip of a front blade. The narrow extending portion of the longitudinally extending body includes a front blade groove and a front blade fastener hole and a front blade fastener.

A broadhead mountable to an arrow shaft for striking a target, upon striking impact is created which deploys the broadhead from a pre-deployment configuration to a post-deployment configuration. The broadhead including a longitudinally extending body, which includes a means for retaining a plurality of mechanically expandable blades while in a post-deployment configuration. The longitudinally extending body including a means for securing the plurality of mechanically expandable blades to the body while in both the pre-deployment configuration and the post-deployment configuration. The broadhead includes a means for not deploying the blades until impact with the target. The broadhead includes a means for deploying a front blade upon impact. The means for deploying the front blade upon impact is mounted over the longitudinally extending body with an alignment position to secure each blade and to set the broadhead in the pre-deployment configuration.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of some of those embodiments.

The apparatus and components have been represented where appropriate by conventional symbols in the drawings, showing specific details that are pertinent to understanding the embodiments of the disclosure herein so as not to obscure the disclosure with details that will be readily apparent to those of ordinary skill in the art having the benefit of the description herein.

DETAILED DESCRIPTION

Figure 1:
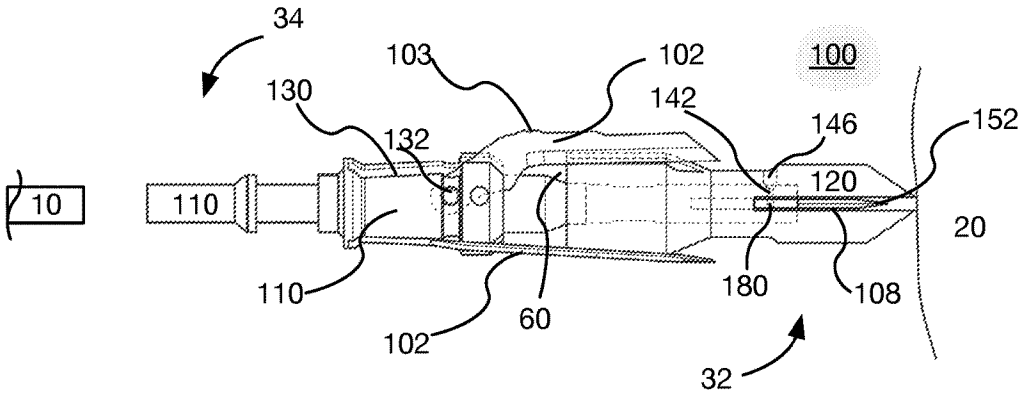
FIG. 1 is a longitudinal plane view of an embodiment of a broadhead arrow before penetration of a target, but prior to the deployment of the blades.
Figure 2:
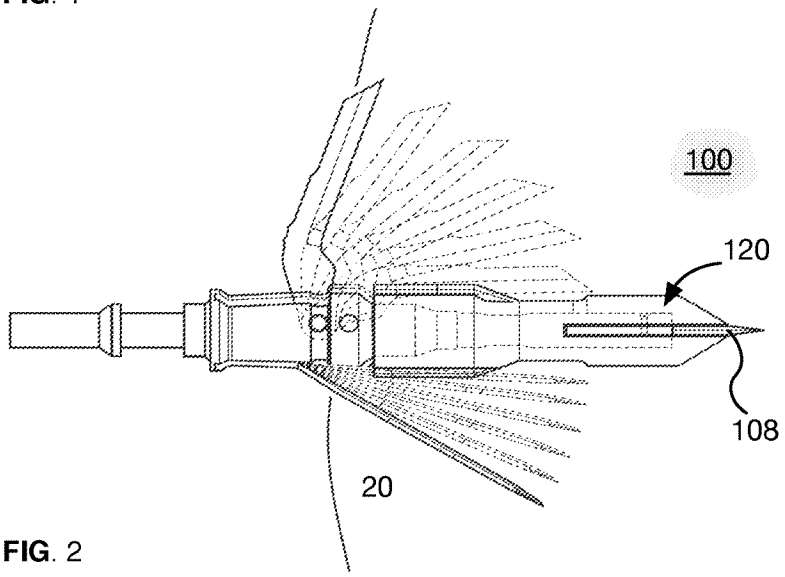
FIG. 2 is a longitudinal plane view of an embodiment of a broadhead arrow after penetration of a target with deployment of the blades.

FIG. 1 is a longitudinal plane view, or what is better described as a mid-sagittal plane view, of an embodiment of a broadhead arrow before penetration of a target, but prior to the deployment of the blades. FIG. 1 illustrates a pre-deployment configuration of the broadhead 100. FIG. 2 illustrates a post-deployment configuration of the broadhead 100. The pre-deployment configuration includes pre-expansion of the plurality of mechanically expandable blades 102, 102, 102 (existent, but not visible in figure due to angles of illustration). The post-deployment configuration includes post-expansion of the plurality of mechanically expandable blades 102, 102, 102. The dotted line drawings of the blades 102, 102, 102, in FIG. 2 illustrate an example embodiment of the expansion of the blades 102, 102, 102, which will have taken place before the blades are fully expanded.

In an embodiment, the broadhead 100 is mountable to an arrow shaft 10 for striking a target 20. The broadhead 100 includes a longitudinally extending body 110 having a distal end 32 and a proximal end 34. The longitudinally extending body 110 includes a plurality of longitudinally extending post-expansion grooves 130, 130, 130. Each groove can retain a respective one of a plurality of mechanically expandable blades 102, 102, 102.

In an embodiment, the mechanically expandable blades 102, 102, 102 and the first deploying front blade 108 will all deploy or open and expand upon impact. In an embodiment, the three main blades 102, 102, 102, which are the long big blades will open backwards opposite of the target on impact to deploy.

Figure 3:
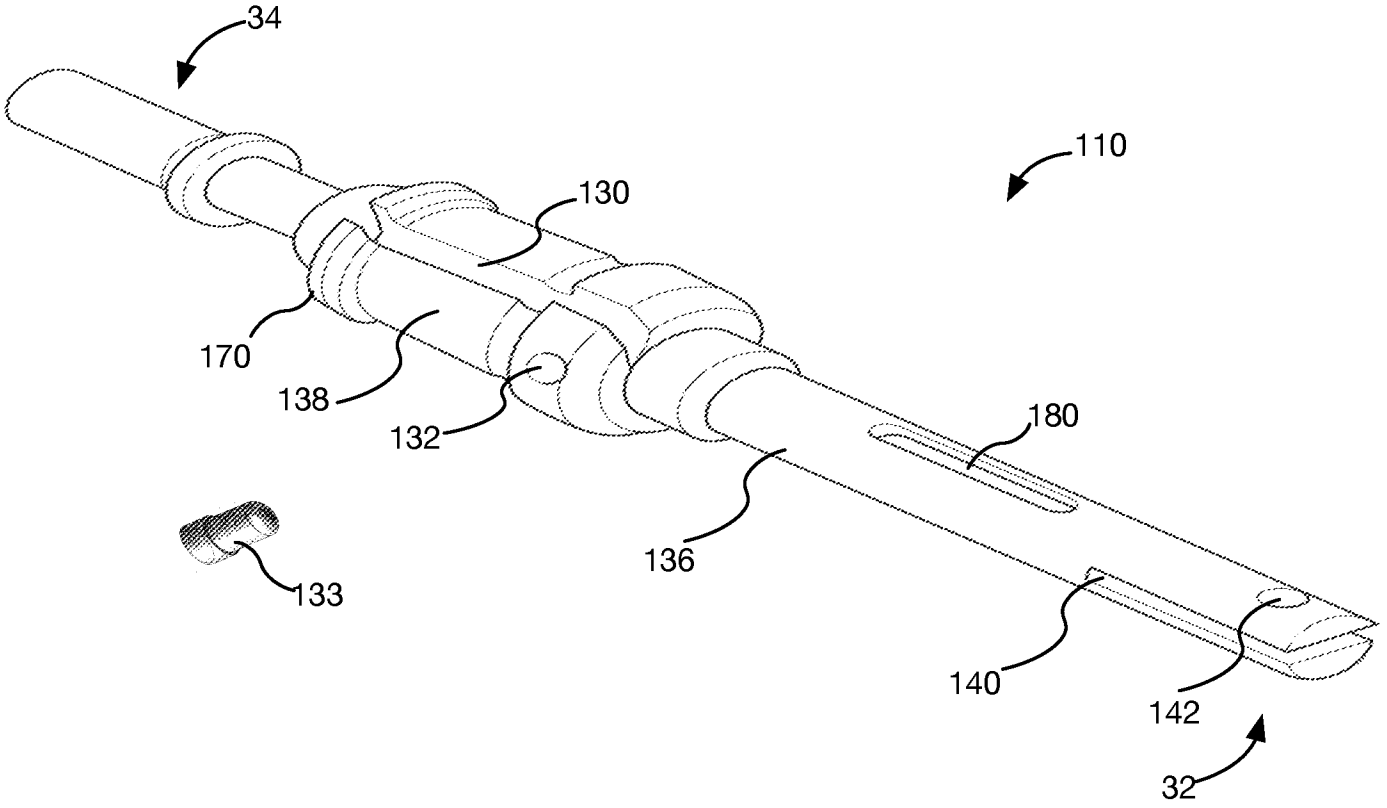
FIG. 3 is a perspective view of an embodiment of a body of the broadhead arrow illustrated in FIG. 1.

The longitudinally extending body 110 includes a respective fastener hole 132 to receive each of a respective blade fastener 133 of a plurality of fasteners 133, 133, 133 (FIG. 3). For example, the plurality of blades and grooves and fasteners can be three. In an embodiment, the plurality can be six. In an embodiment, the plurality can be and number functional with the dimensions of the broadhead 100.

FIG. 3 is a perspective view of an embodiment of a body of the broadhead arrow illustrated in FIG. 1. In an embodiment, the main blades will be screwed into a longitudinally extending body 110. The longitudinally extending body 110 includes a narrow extending portion 136 at the distal end 32, and includes a post-expansion blade retention portion 138.

In an embodiment, each of the fasteners 133 retains each of the respective blades of the plurality of expandable blades 102, 102, 102, during both pre-expansion and post-expansion. In an embodiment, when in pre-expansion the blades are retained partially inside each respective post-expansion groove 130. In an embodiment, each blade 102 includes a retention groove 130 positioned at the proximal end 34 of each blade when in pre-expansion configuration.

Figure 4:
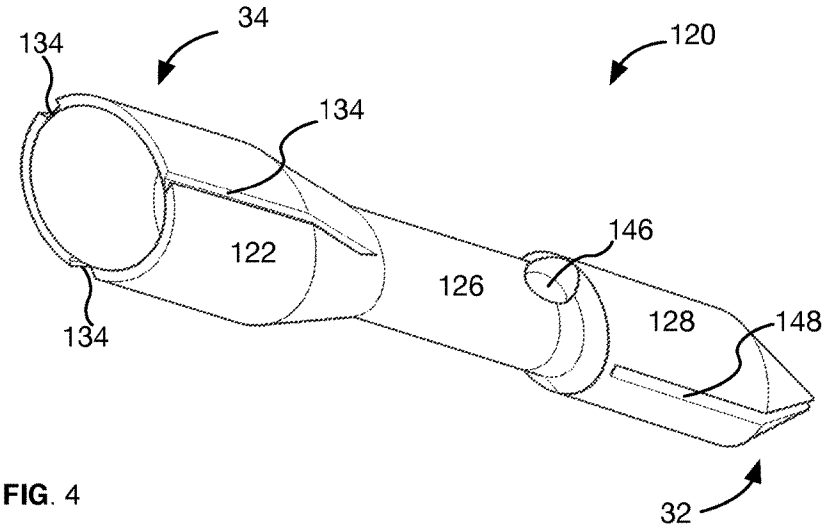
FIG. 4 is a perspective view of an embodiment of a sliding portion of the broadhead arrow illustrated in FIG. 1.

FIG. 4 is a perspective view of an embodiment of a sliding portion of the broadhead arrow illustrated in FIG. 1. In an embodiment, the broadhead 100 includes a hollow cylindrical sliding portion 120. The hollow cylindrical sliding portion 120 can include a pre-expansion blade retention hollow cylindrical portion 122 and a hollow cylindrical body 126 and a hollow tip cylindrical portion 128. The pre-expansion blade retention hollow cylindrical portion 122 includes a corresponding pre-expansion groove 134, 134, 134 aligned respective and corresponding to each of the plurality of expandable blades 102, 102, 102 to retain each blade 102 inside each respective pre-expansion groove 134 when in pre-expansion configuration. In an embodiment, a means for blade deployment actuation which is also the means for deploying the front blade upon impact is a hollow cylindrical sliding portion 120. In an embodiment, a means for blade deployment actuation is a hollow cylindrical sliding portion 120. In an embodiment, a means for deploying the front blade upon impact is a hollow cylindrical sliding portion 120.

As illustrated in FIGS. 1-10, in an embodiment, the hollow cylindrical sliding portion 120 is a means for all blade deployment actuation. In an embodiment, the hollow cylindrical sliding portion 120 is a means for deploying the front tip blade 108. In an embodiment, the hollow cylindrical sliding portion 120 is a means for deploying the plurality of mechanically expandable blades 102. In an embodiment, upon striking the target, the hollow cylindrical sliding portion 120 slides back to expose the front blade 108. In an embodiment, upon striking the target, the hollow cylindrical sliding portion 120 slides back to actuate expansion of the plurality of mechanically expandable blades 102. In an embodiment, upon striking the target, the hollow cylindrical sliding portion 120 slides back to expose the front blade 108 and simultaneously slides back to actuate expansion of the plurality of mechanically expandable blades 102.

As illustrated in FIG. 1, in an embodiment, the hollow cylindrical sliding portion 120 is mounted over the longitudinally extending body 110 with an alignment position to secure each blade 102 with the respective blade fastener 133 to set the broadhead in the pre-deployment configuration where each blade 102 is in a pre-expansion configuration, and the front blade 108 is at least partially covered by the hollow cylindrical sliding portion 120 to be in a pre-piercing configuration.

In an embodiment, the hollow cylindrical body 120 mounts over the base of the narrow extending portion 136. In an embodiment, the tip cylindrical portion 128 mounts over the distal end 32 of the narrow extending portion 136. In an embodiment, the tip cylindrical portion 128 mounts over at least a portion of a tip 152 (See FIG. 7) of a front blade 108 when in a pre-deployment configuration. In an embodiment, the narrow extending portion 136 of the longitudinally extending body 110 includes a front blade groove 140 and a front blade fastener hole 142 and a front blade fastener.

Figure 5:
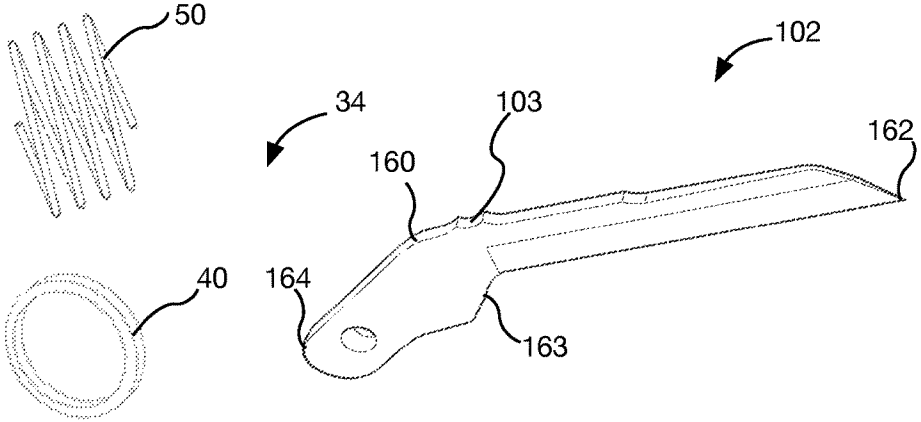
FIG. 5 is a perspective view of an embodiment of a blade of the broadhead arrow illustrated in FIG. 1 along with embodiments of means for blade retention and means for blade deployment actuation.

FIG. 5 is a perspective view of an embodiment of a blade of the broadhead arrow illustrated in FIG. 1. In an embodiment, an band 40 is positioned along the blade grooves 103, 103, 103 to retain the blades 102, 102, 102 from expanding before impact. In an embodiment, an band 40 is a loop of elastomer with a round cross-section, designed to be seated in one or more of the grooves. In an embodiment, the broadhead 100 includes a means of providing a retention force to maintain the blades in compact pre-deployment configuration until impact. In an embodiment, a band is an o-ring or a rubber band. In an embodiment, an o-ring is a toric joint in the shape of a torus. In an embodiment, a means for not deploying the blades until impact with the target is a band.

In an embodiment, the location of the groove 103 on the blade 102 is at the proximal end 34 of each blade when in pre-expansion configuration. In an embodiment, the location of the retention groove 103 of each blade 102 is located between the maximum angle bend 160 of the blade and the proximate end 164 of the blade. In an embodiment, the location of the retention groove 103 of each blade 102 is located between the maximum angle bend 160 of the blade and the distal end 162 of the blade.

In an embodiment, a broadhead 100 includes a means of blade expansion actuation. In an embodiment, a means of blade expansion actuation blade actuation includes a coil 50, which can be positioned in a location 60 (See FIG. 1) between an interior side 163 of each blade and the proximate end of the hollow cylindrical sliding portion 120. In an embodiment, a means for deploying a front blade upon impact is a hollow cylindrical sliding portion 120.

Figure 6:
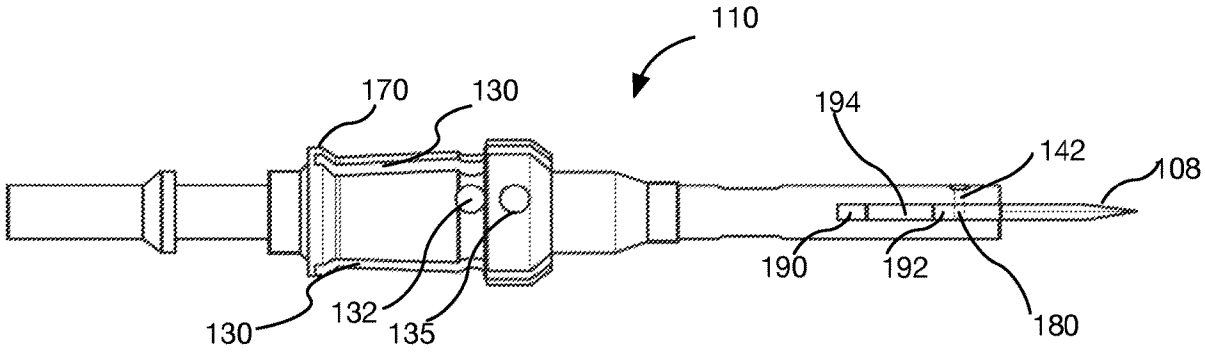
FIG. 6 is a longitudinal plane view of an embodiment of a longitudinally extending body with a secured front blade, of the broadhead embodiment illustrated in FIG. 1.

FIG. 6 is a longitudinal plane view of an embodiment of a longitudinally extending body with a secured front blade, of the broadhead embodiment illustrated in FIG. 1. Viewed with the help of FIGS. 3, 4, and 6, in an embodiment, the hollow cylindrical sliding portion 120 of the mechanically expandable broadhead 100 includes a hollow body hole 146 to correspond with and align with the front blade fastener hole 142 of the longitudinally extending body 110.

Illustrated in FIG. 6 is an alternative embodiment of the respective fastener hole 132, each of which is to receive each of a respective blade fastener 133 to secure each of a respective blade 102. In an embodiment, a means for securing the plurality of mechanically expandable blades to the body while in both the pre-deployment configuration and the post-deployment configuration is a respective blade fastener 133. In an embodiment, a means for securing the front blade to the longitudinally extending body while the means for deploying the front blade upon impact moves from a pre-deployment configuration to a post-deployment configuration is a blade fastener 133.

FIG. 6 illustrates an alternative location 135 for the fastener hole 132. For example, location 135 can be located on the longitudinally extending body 110 further from the blade retention base 170. In an embodiment, the blade retention base 170 is positioned on the longitudinally extending body 110 to stop the blade 102 after it is deployed. For example, when the location 135 of the fastener hole 132 is positioned further from the blade retention base 170, the blade 103 can expand further as it would not be stopped by the blade retention base 170. In an embodiment, a means for retaining a plurality of mechanically expandable blades while in a post-deployment configuration is blade retention base 170. In an embodiment, a means for retaining a plurality of mechanically expandable blades 102, 102, 102 by their respective side planes, while in a post-deployment configuration, is a plurality of respective post-expansion grooves 130, 130, 130.

Figure 7:
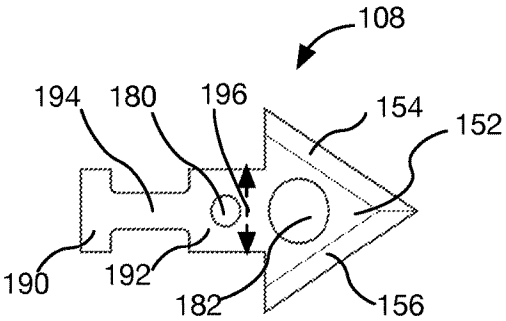
FIG. 7 is a top plan view of an embodiment of a front blade of the broadhead arrow illustrated in FIG. 1.

FIGS. 6 and 7 illustrate an embodiment, wherein the front blade 108 includes an arrow tip hole 180 to correspond and align with the front blade fastener hole 142 of the longitudinally extending body 110. FIGS. 6 and 7 illustrate an embodiment, wherein the front blade 108 includes an arrow tip hole 180 to correspond and align with the front blade fastener hole 142 of the longitudinally extending body 110. The embodiment includes an extended base portion 190. In the embodiment, the front blade 108 is secured to the longitudinally extending body 110 with a fastener (not shown). In an embodiment, the fastener is secured through the front blade fastener hole 142 of the longitudinally extending body 110, and through the arrow tip hole 180, and secures the front blade 108 to the longitudinally extending body 110. In an embodiment, the fastener secures the front blade 108 to the longitudinally extending body 110 without interfering with a sliding back motion 30 (See FIGS. 9 and 10) of the hollow cylindrical sliding portion 120 when the broadhead 100 moves from a pre-expansion configuration to a post-expansion configuration.

Figure 8:
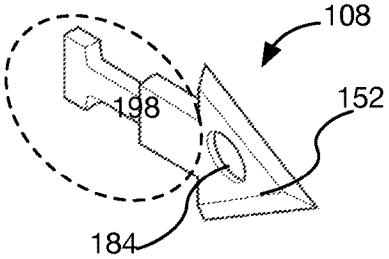
FIG. 8 is a perspective view of an embodiment of a front blade of the broadhead arrow illustrated in FIG. 1.

FIG. 7 is a top plan view of an embodiment of a front blade of the broadhead arrow illustrated in FIG. 1. FIG. 8 is a perspective view of another embodiment of a front blade 108 of the broadhead arrow illustrated in FIG. 1. In an embodiment, the front blade 108 does not have both an arrow tip hole 180 and a light weight hole 182. In FIG. 8, the embodiment of a front blade 108 includes a means for fastening the front blade 108 to the longitudinally extending body 110, which is for example only the arrow tip hole 184. In an embodiment of the broadhead 110, the width 196 of a base 198 (encircled with dashed line in FIG. 8) of the front blade 108 is less than or equal to the width of the distal end of the longitudinally extending body 110. In an embodiment, the portion of the front blade excluding the base 198 is the means for initial cutting of the target. In an embodiment the means for initial cutting of the target includes a plurality of triangular tapered cutting blade edges 154, 156. In an embodiment, the plurality of triangular tapered edges is two. In an embodiment, the plurality of triangular tapered edges is three or four, or more as limited by the physical characteristics of the front blade 108.

In an embodiment, a planar surface of the front blade groove 140 of the broadhead 110 secures at least a portion of planar surface of the front blade 108. In an embodiment, a planar surface of the front blade groove 140 of the broadhead 110 secures a portion of planar surface of the front blade 108 except for the triangular tapered cutting blade edges 154, 156. In an embodiment, a front blade groove 140 of the broadhead 110 aligns with a front glade groove 148 of the hollow cylindrical sliding portion 120.

Figure 9:
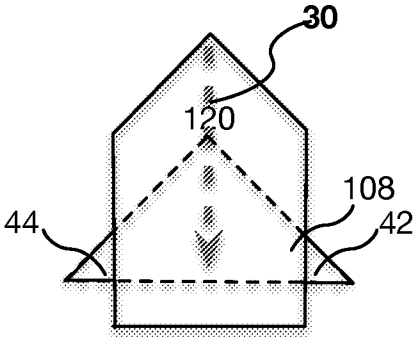
FIG. 9 is a top plan view of a pre-deployment configuration of an embodiment of portions of a front blade and a sliding portion.
Figure 10:
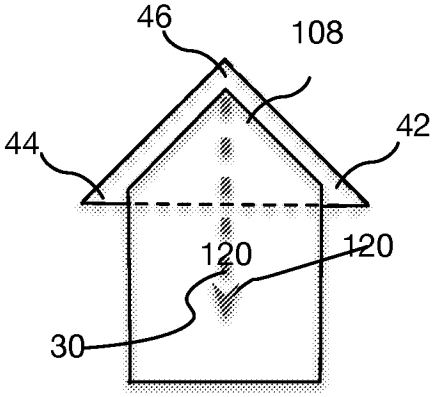
FIG. 10 is a top plan view of a post-deployment configuration of an embodiment of portions of a front blade and a sliding portion.

FIG. 9 is a top plan view of a pre-deployment configuration of a partial embodiment of a front blade 108 and a sliding portion 120. FIG. 10 is a top plan view of a post-deployment configuration of the partial embodiment of the front blade 108 and the sliding portion 120. In an embodiment, a sliding motion 30 results from impact of the broadhead 100 upon the target 20. The sliding motion moves the sliding portion 120 of the broadhead 100 back to expose a greater portion of the front blade 108.

FIGS. 1-10 illustrate an embodiment of a broadhead 100 wherein the front blade 108 includes an arrow tip hole 180 to correspond and align with the front blade fastener hole 142 of the longitudinally extending body 110, and includes an extended base portion 190. In an embodiment, the front blade 108 is secured to the longitudinally extending body 110 with a fastener (not shown) passing through the front blade fastener hole 142 of the longitudinally extending body 110, and passing through the arrow tip hole 180, and securing the front blade 108 to the longitudinally extending body 110 without interfering with a sliding back motion 30 of the hollow cylindrical sliding portion 120 when the broadhead 100 moves from a pre-expansion configuration to a post-expansion configuration. In an embodiment, at least a larger portion of triangular tapered edges 154, 156 become exposed after the cylindrical sliding portion 120 executes the sliding back motion.

FIGS. 1-10 illustrate an embodiment, wherein a broadhead 100 has a sliding portion 120 planarly covering a front blade tip 46 of a front blade 108 when the broadhead is in pre-deployment configuration. In an embodiment, a broadhead 100 has a sliding portion 120 not planarly covering a front blade tip 46 of a front blade 108 when the broadhead is in post-deployment configuration. In an embodiment, a broadhead 100 has a sliding portion 120 not planarly covering at least one of a plurality of sides 42, 44 of a front blade 108 when the broadhead is in pre-deployment configuration.

In an embodiment, a screw on tip can be used instead of the front blade 108 illustrated in the Figures. In an embodiment, any fastener of the broadhead 100 can include threading as the means for fastening into their respective receiving hole. In an embodiment, any means for fastening known in the art at the time of the invention can be used. In an embodiment, the fastener is a screw. In an embodiment, any means for cutting known in the art at the time of the invention can be used. In an embodiment, any means for sliding to expose more of the front blade after impact known in the art at the time of the invention can be used.

The invention claimed is:

1. A broadhead mountable to an arrow shaft for striking a target, the broadhead comprising:

a longitudinally extending body having a distal end and a proximal end;

the longitudinally extending body including a plurality of longitudinally extending post-expansion grooves, each groove to retain a respective one of a plurality of mechanically expandable blades;

the longitudinally extending body includes a respective fastener hole to receive each of a respective fastener of a plurality of fasteners;

each of the fasteners retains each of the respective blades of the plurality of expandable blades pre-expansion and post-expansion, when in pre-expansion the blades are retained partially inside each respective post-expansion groove;

the longitudinally extending body includes a narrow extending portion at the distal end, and includes a post-expansion blade retention portion; and a hollow cylindrical sliding portion including a pre-expansion blade retention hollow cylindrical portion and a hollow cylindrical body and a hollow tip cylindrical portion;

the pre-expansion blade retention hollow cylindrical portion includes a corresponding pre-expansion groove aligned respective and corresponding to each of the plurality of expandable blades to retain each blade inside each respective pre-expansion groove when in pre-expansion configuration;

the hollow cylindrical sliding portion is mounted over the longitudinally extending body with an alignment position to secure each blade with the respective fastener to set the broadhead in the pre-expansion configuration;

the hollow cylindrical body mounts over the base of the narrow extending portion;

the tip cylindrical portion mounts over the distal end of the narrow extending portion;

the tip cylindrical portion mounts over at least a portion of a tip of a front blade;

the narrow extending portion of the longitudinally extending body includes a front blade groove and a front blade fastener hole and a front blade fastener.

2. The mechanically expandable broadhead of claim 1, wherein hollow cylindrical sliding portion includes a hollow body hole to correspond and align with the front blade fastener hole of the longitudinally extending body.

3. The mechanically expandable broadhead of claim 1, wherein each of the blades includes an retention groove positioned at the proximal end of each blade when in pre-expansion configuration, the retention groove of each blade is located between the maximum angle bend of the blade and the proximate end of the blade.

4. The mechanically expandable broadhead of claim 1, wherein the retention groove of each blade is located between the maximum angle bend of the blade and the distal end of the blade.

5. The mechanically expandable broadhead of claim 1, further comprising a coil between the between an interior side of each blade and the means for deploying the front blade upon impact.

6. The mechanically expandable broadhead of claim 1, wherein the front blade includes a plurality of triangular tapered edges.

7. The mechanically expandable broadhead of claim 1, wherein a planar surface of the front blade groove secures at least a portion of planar surface of the front blade.

8. The mechanically expandable broadhead of claim 1, wherein the front blade includes an arrow tip hole to correspond and align with the front blade fastener hole of the longitudinally extending body.

9. The mechanically expandable broadhead of claim 1, wherein the front blade includes an arrow tip hole to correspond and align with the front blade fastener hole of the longitudinally extending body, and includes an extended base portion; the front blade secured to the longitudinally extending body with a fastener passing through the front blade fastener hole of the longitudinally extending body, and passing through the arrow tip hole, and securing the front blade to the longitudinally extending body without interfering with a sliding back motion of the hollow cylindrical sliding portion when the broadhead moves from a pre-expansion configuration to a post-expansion configuration.

10. The mechanically expandable broadhead of claim 1, wherein the front blade includes an arrow tip hole to correspond and align with the front blade fastener hole of the longitudinally extending body, and includes an extended base portion;

the front blade secured to the longitudinally extending body with a fastener passing through the front blade fastener hole of the longitudinally extending body, and passing through the arrow tip hole, and securing the front blade to the longitudinally extending body without interfering with a sliding back motion of the hollow cylindrical sliding portion when the broadhead moves from a pre-expansion configuration to a post-expansion configuration;

wherein at least a larger portion of triangular tapered edges become exposed after the cylindrical sliding portion executes the sliding back motion.

11. A broadhead mountable to an arrow shaft for striking a target, upon striking impact is created which deploys the broadhead from a pre-deployment configuration to a post-deployment configuration, said broadhead comprising:

a longitudinally extending body;

the longitudinally extending body including a means for retaining a plurality of mechanically expandable blades while in a post-deployment configuration;

the longitudinally extending body including a means for securing the plurality of mechanically expandable blades to the body while in both the pre-deployment configuration and the post-deployment configuration;

a means for not deploying the blades until impact with the target; and a means for deploying a front blade upon impact;

the means for deploying the front blade upon impact is mounted over the longitudinally extending body with an alignment position to secure each blade and to set the broadhead in the pre-deployment configuration.

12. The mechanically expandable broadhead of claim 11, wherein the means for deploying the front blade upon impact includes a hollow cylindrical sliding portion including a hollow body hole to correspond and align with a front blade fastener hole of the longitudinally extending body.

13. The mechanically expandable broadhead of claim 11, wherein a retention groove of each blade is located between a maximum angle bend of the blade and a proximate end of the blade.

14. The mechanically expandable broadhead of claim 11, wherein each of the blades includes an retention groove positioned at the proximal end of each blade when in pre-expansion configuration, the retention groove of each blade is located between the maximum angle bend of the blade and the proximate end of the blade.

15. The mechanically expandable broadhead of claim 11, further comprising a coil between the between an interior side of each blade and the means for deploying the front blade upon impact.

16. The mechanically expandable broadhead of claim 11, wherein the front blade includes a plurality of cutting edges.

17. The mechanically expandable broadhead of claim 11, wherein a planar surface of the front blade groove of longitudinally extending body secures at least a portion of planar surface of the front blade.

18. The mechanically expandable broadhead of claim 11, wherein the front blade includes an arrow tip hole to correspond and align with a front blade fastener hole of the longitudinally extending body.

19. The mechanically expandable broadhead of claim 11, further comprising a means for securing the front blade to the longitudinally extending body while the means for deploying the front blade upon impact moves from a pre-deployment configuration to a post-deployment configuration; wherein at least a larger portion of triangular tapered edges of the front blade become exposed after the means for deploying the front blade upon impact moves from the pre-deployment configuration to the post-deployment configuration.

20. The mechanically expandable broadhead of claim 11, further comprising a means for blade deployment actuation, which is also the means for deploying the front blade upon impact.

* * * * *